United States Patent [19]

Inaba et al.

[11] Patent Number: 4,844,642

[45] Date of Patent: Jul. 4, 1989

[54] CAP FOR WRITING EQUIPMENT

[75] Inventors: Takao Inaba; Kenji Sakai; Tadao Iida; Masahisa Maki, all of Aichi, Japan

[73] Assignee: Pilot Ink Co., Ltd., Aichi, Japan

[21] Appl. No.: 168,637

[22] Filed: Mar. 4, 1988

Related U.S. Application Data

[63] Continuation of Ser. No. 866,836, May 27, 1986, abandoned.

[30] Foreign Application Priority Data

May 27, 1985 [JP] Japan ..... 60-113423

[51] Int. Cl.[4] ..... B43K 9/00

[52] U.S. Cl. ..... 401/213; 401/202; 401/243; 401/247

[58] Field of Search ..... 401/258, 243, 242, 247, 401/202, 269, 259, 213; 24/10 R

[56] References Cited

U.S. PATENT DOCUMENTS

| | | | |
|---|---|---|---|
| 3,502,417 | 3/1970 | Hartmann | 401/202 |
| 3,547,552 | 12/1970 | Rösler | 401/243 |
| 3,565,540 | 2/1971 | Andrews | 401/202 |
| 3,802,788 | 4/1974 | Danjczek | 401/247 |
| 4,231,669 | 11/1980 | Rosbiegalle | 401/258 |
| 4,355,726 | 10/1982 | Mutschler | 401/213 |

FOREIGN PATENT DOCUMENTS

| | | | |
|---|---|---|---|
| 204252 | 12/1986 | European Pat. Off. | 401/213 |
| 1935399 | 1/1966 | Fed. Rep. of Germany . | |
| 1239589 | 4/1967 | Fed. Rep. of Germany | 401/245 |
| 2138694 | 2/1973 | Fed. Rep. of Germany . | |
| 929888 | 1/1948 | France | 401/247 |
| 2302203 | 9/1976 | France | 401/247 |
| 206548 | 2/1984 | German Democratic Rep. | 401/213 |
| 17406 | of 1911 | United Kingdom | 401/259 |
| 2067960 | 8/1981 | United Kingdom | 401/213 |

*Primary Examiner*—Randolph A. Reese
*Assistant Examiner*—Anthony Knight
*Attorney, Agent, or Firm*—Sughrue, Mion, Zinn, Macpeak & Seas

[57] ABSTRACT

The cap for writing equipment comprises an air vent in the top portion, means installed on the inner peripheral surface for providing airtightness, a miniature cap movably enclosed in the axial direction in a space formed with the top face, the inner peripheral face and an annular boss for providing airtightness, a resilient seal positioned on the outside of the top of the miniature cap for blocking the ventilation between the air vent and the inside of the cap when the tip of the pen body is fitted into the cap and rebounders for pressing the miniature cap against the pen body. The annular boss for providing airtightness is so positioned as to block the ventilation in the longitudinal direction by forcing itself to contact the trunk of the pen when the tip of the pen body is fitted into the cap.

11 Claims, 3 Drawing Sheets

FIG. 1A
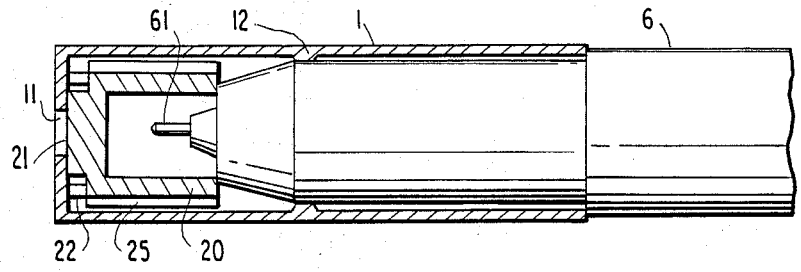
FIG. 1B
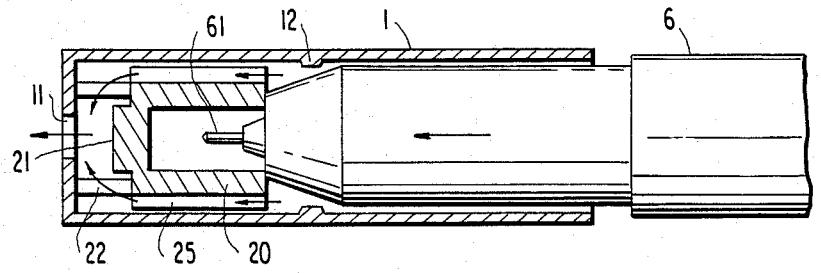
FIG. 2
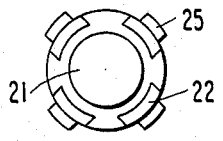
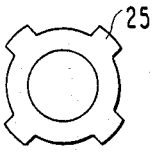
FIG. 3
FIG. 4A
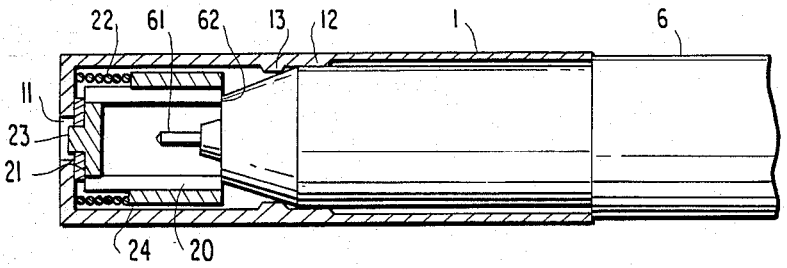
FIG. 4B
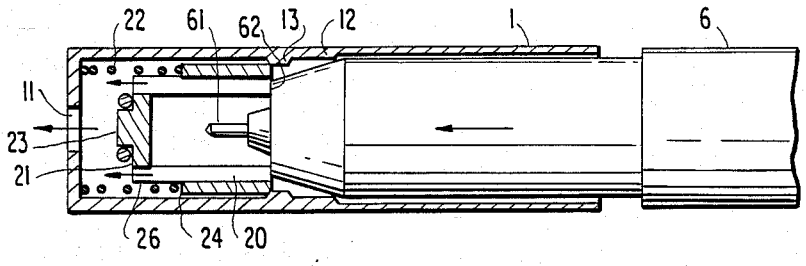
FIG. 5
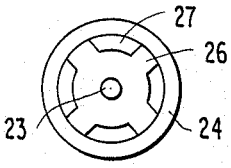
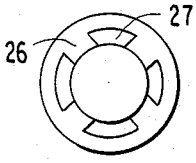
FIG. 6

CAP FOR WRITING EQUIPMENT

This is a continuation of application Ser. No. 866,836 filed May 27, 1986, now abandoned.

BACKGROUND OF THE INVENTION

This invention relates to a cap equipped with a mechanism for preventing ink from flowing over the tip of writing equipment such as a pen containing low viscosity liquid ink, and more particularly to a cap effective for writing equipment storing free ink in the body.

A volatile solvent such as water and ethanol is used for low viscosity liquid ink as a main solvent and accordingly caps for writing equipment, e.g. pens containing the liquid ink are so framed as to keep airtight the thin pointed pieces of the pens when they are mounted thereon to prevent the ink from drying. In this sort of pens with caps mounted thereon, the air inside the caps is compressed and caused to flow into the trunks of the pen bodies. In consequence, the pressure in the bodies becomes higher than the atmospheric pressure.

FIG. 12 shows the method of measuring pressure changes in the trunks of the pen bodies. In FIG. 12, a U-shaped tube is filled with water and one end of the tube communicates with the trunk of a pen body, the other end being open. The difference between the water levels is measured while a cap is mounted thereon.

In the case of a conventional cap, the internal pressure of the cap mounted on a pen is seen to increase substantially according to the measurement.

Problems inherent in the conventional cap include often soiling hands, writing paper and clothes because the compressed air contained in the trunk of the pen body expands when the cap is detached from the pen and forces the ink to spout out of the air vent provided at the tip of the pen or close thereto. Such a phenomenon as exemplified above is often the case with writing equipment storing free ink in the trunks of the bodies.

SUMMARY OF THE INVENTION

The cap according to the present invention comprises an air vent in the top portion, means installed on the inner peripheral face for providing airtightness, a miniature cap movably enclosed in the axial direction of a space formed with the top face, the inner peripheral face and the means for providing airtightness, a resilient seal positioned on top of the miniature cap for blocking the ventilation between the air vent and the inside of the cap when the pen body is inserted into the cap from the tip thereof and rebounders for pressing the miniature cap against the pen body. The means for providing airtightness is so positioned as to block the ventilation in the longitudinal direction by forcing itself to contact the trunk of the pen when the pen body is inserted from the tip thereof into the cap.

There will be illustrated a process wherein the pen is inserted from the tip thereof into the cap thus constructed and fitted in position. While the tip of the pen is pressing the miniature cap against the inner top face of the cap, the rebounders pressed against the inner top face of the cap prevent the miniature cap from contacting the inner top face and the air in the cap compressed by the insertion of the pen body is discharged from the air vent provided in the top portion of the cap. When the cap is completely fitted to the pen body, the resilient seal provided on top of the miniature cap is pressed against the top face of the cap, blocking the ventilation between the air vent and the inside of the cap, and means for providing airtightness is pressed against the trunk of the pen body so as to block the ventilation in the longitudinal direction. Accordingly, the pressure inside the cap above the means for providing airtightness where the tip of the pen is accommodated becomes almost equal to the atmospheric pressure and the inside thereof is kept airtight.

When the cap is detached, an instantaneous pressure change within the cap is prevented through the process reverse to the above process. In other words, when the cap and the pen body are moved apart slightly and relatively, the force applied by the tip of the pen to the miniature cap toward the inner top face of the cap is released and simultaneously the miniature cap is pressed against the pen body by the action of the rebounders. In consequence, the resilient seal releases the interrupted ventilation between the air vent and the inside of the cap and allows the inside of the cap to communicate with the atmosphere.

BRIEF DESCRIPTION OF THE DRAWINGS

FIGS. 1A, 1B, 4A, 4B, 8 and 10 are vertical sectional views of caps embodying the present invention.

FIGS. 2 and 3 are respectively a plan view and a bottom plan view of the miniature cap of FIG. 1A.

FIGS. 5 and 6 are respectively a plan view and a bottom plan view of the miniature cap of FIG. 4A.

DETAILED DESCRIPTION OF THE INVENTION

Figure 7:
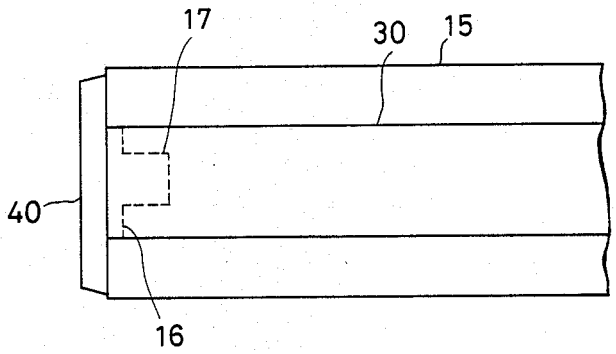
FIG. 7 is an elevational view of the principal portion of the cap embodying the present invention.

FIGS. 1A, 1B are vertical sectional views of a cap 1 embodying the present invention, the cap comprising a minimum number of parts. FIG. 1A of the drawing shows a state wherein the pen body 6 has been fitted into the cap, whereas it is being fitted into the cap in FIG. 1B.

In FIGS. 1A, 1B, there is shown an arrangement of a cap 1, an air vent 11, a means 12 or annular boss for providing airtightness, a miniature cap 20 prepared from rubber or elastic resin, a resilient seal 21 in the top center portion thereof, rebounders 22 around the top face and four external bosses 25 symmetrical about the outer peripheral face.

As shown in FIG. 1A of the drawing, the resilient seal 21 of the miniature cap is pressed against the top face of the cap 1 by the pen body 6 when the pen body 6 is fitted into the cap 1 and the air vent 11 is sealed. The ventilation in the longitudinal direction is simultaneously blocked by the annular boss 12 and the trunk of the pen body 6 abutting on each other under pressure. Accordingly, the inside of the cap where the tip 61 of the pen is accommodated is kept airtight.

While the pen body 6 is being fitted into the cap 1 as shown in FIG. 1B of the drawing, the action of the rebounders 22 prevents the top face of the miniature cap from abutting on the inner top face of the cap and the air in the cap is compressed by the insertion of the pen body and discharged from the air vent 11 through the gap formed by the external bosses 25 between the outer peripheral face of the miniature cap and the inner peripheral face of the cap. The arrow in FIG. 1B represents the air flow at that time and that state is maintained until the pen body 6 is completely fitted into the cap 1. Accordingly, the inside of the cap is roughly kept at the atmospheric pressure after the pen body is fitted therein.

FIGS. 2 and 3 are a top view and a bottom view of the miniature cap of FIG. 1.

FIGS. 4A, 4B are vertical sectional views of a cap 1 embodying the present invention, the miniature cap is made of a mold of general purpose resin and, as in the case of FIG. 1A, FIG. 4A of the drawing shows a state after the pen body 6 has been fitted into the cap 1, whereas it is being fitted therein in FIG. 4B. The cap 1 is equipped with the air vent 11 in the top center portion, the inner boss 13 for preventing the miniature cap from moving downwardly and the means 12 for providing airtightness, the means being installed on the lower inner peripheral face.

The miniature cap 20 is provided with a projection 23 in the top center portion, the projection 23 supporting a ring member 21 formed of an elastic material, four bosses 26 symmetrical about the inner peripheral face in the axial direction and a shoulder 24 at the end of an outer peripheral portion 20*a*, the shoulder 24 being abutted by a spring 22 as a rebounder, and opening 27 around the projections 23 in the top portion, the opening 27 communicating with the gap between the bosses.

During the course where the pen body is fitted into the cap, the front end shoulder 62 of the pen body 6 abuts the lower end faces of the bosses 26 and presses the miniature cap 20 against the inner top face of the cap. However, the gap between the elastic ring member or resilient seal member 21 and the inner top face of the cap is maintained immediately before the pen body is completely fitted into the cap because of the repulsion force of the spring 22 and the air compressed in the cap is discharged from the air vent 11 into the atmosphere through the miniature cap and the opening 27. When the pen body has completely been fitted into the cap, the ventilation between the air vent 11 and the inside of the cap is blocked because of the action of the resilient seal 21 and the ventilation in the longitudinal direction is also blocked as the annular boss 12 abuts the trunk of the pen, so that the inside of the cap containing the tip 61 of the pen is kept airtight. FIGS. 5 and 6 are a top view and a bottom view of the miniature cap of FIG. 4.

Figure 8:
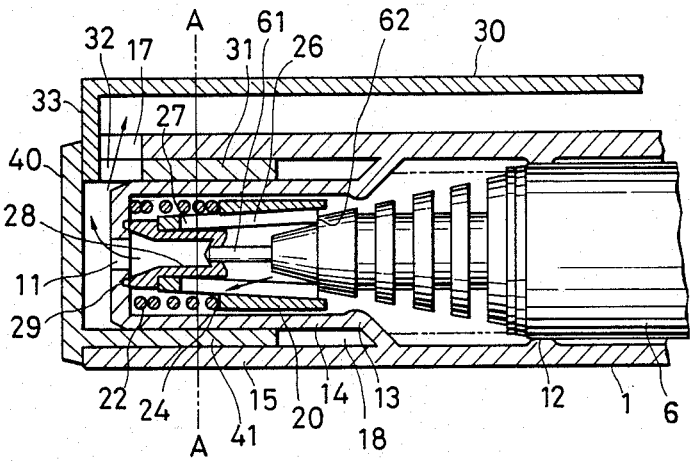

FIG. 7 is an elevational view illustrating the principal portion of another cap embodying the present invention, the cap being adapted to be equipped with accessories such as clips and crowns. FIG. 8 is a vertical sectional view of the principal portion of the cap mounted on the pen.

The cap head is of double construction, i.e., having an internal tube 14 and an external tube 15. The internal tube 14 includes an internal boss 13 at the lower end and expands radially so as to integrate with the external tube 15. The air vent 11 is provided in the top center face and the miniature cap 20 is movably enclosed in the axial direction thereof. The external tube 15 is formed so that its opening is positioned higher than the top face of the internal tube and the opening is provided with a partial cut 16 and a small gap 17 continuously provided in the axial direction of the cut. In the external tubular face lower than what incorporates the inner tube 14, there is formed means 12 having the annular boss for providing airtightness.

Figure 9:
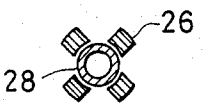
FIG. 9 is a sectional view of the miniature cap taken on line A—A of FIG. 8.

The miniature cap 20 is a cylindrical body having a shoulder 24 on the outer periphery, four symmetrical bosses 26 on the inner peripheral face extending in the axial direction and an opening 27 extending from the shoulder to the upper side thereof, an inner lid 28 of resilient material being fitted into the opening of the cylindrical body (see FIGS. 8 and 9).

A spring 22 is installed in between the inner top face of the internal tube 14 and the shoulder 24 of the miniature cap 20 and the brim 29 of the inner lid located on top of the miniature cap plays a role as a resilient seal.

A U-shaped clip 30 is fixed to the cap by inserting a piece 31 of the clip 30 between the inner and the outer tubes, the piece 31 being provided with a slit 32 corresponding to the gap 17 in the opening of the external tube 15, and piece 31 engaging a right angle connection 33 passing through the partial cut 16 (see FIGS. 7 and 8).

A crown 40 is installed on top of the cap by pressing a leg 41 formed correspondingly to the annular gap 18 between the inner and outer tubes.

While the pen body is being fitted into the cap, the front shoulder 62 of the pen body abuts on the lower end face of the boss 26 of the miniature cap 20 and forces the miniature cap toward the top face of the inner tube 14. However, the gap between the top face of the inner tube and the brim 29 of the inner lid 28 of the top portion of the miniature cap is maintained by the repulsion force of the spring 22 and the compressed air within the cap is caused to pass through the miniature cap and then discharged from the small gap 17 through the opening 27, the air vent 11 and the slit 32.

When the cap is completely mounted on the pen, the brim 29 of the inner lid of the miniature cap is pressed against the top face of the inner tube by the pen body to block the ventilation between the air vent 11 and the inner tube and simultaneously block the ventilation in the longitudinal direction as the annular boss 12 of the outer tube 15 is pressed against the drum of the pen body. The space between the top face of the inner tube containing the tip 61 of the pen and the annular boss 12 is kept airtight, at a pressure almost equal to the atmospheric pressure. In that case, the top face of the inner lid also acts as a seal for the tip 61 of the pen.

When the cap is detached and relatively moved from the pen body, the miniature cap is instantaneously pressed toward the pen body by the spring 22, which causes the brim 29 of the inner lid to move apart from the top face of the inner tube, so that the inside of the cap is allowed to communicate with the atmosphere through the air vent 11.

Figure 10:
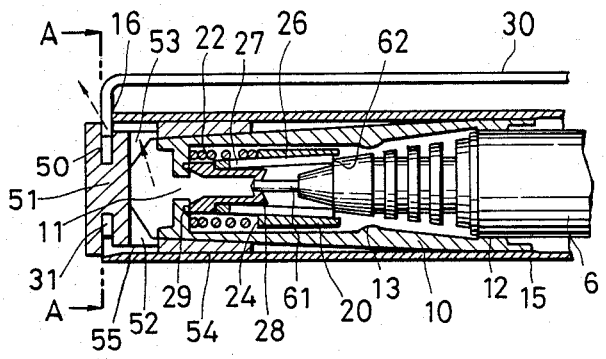

FIG. 10 is a vertical sectional view illustrating a principal portion wherein a pen body is fitted into a cap embodying the present invention, the cap being so arranged as to receive accessories such as clips and crowns.

The inner cap 10 comprises an air vent 11 in the top center, an inner boss 13 on the inner peripheral face and a means 12 for providing airtightness, the means comprising an annular boss continuous from an inner boss 13 up to the lower inner peripheral face. A miniature cap 20 is movable in the axial direction of an enclosed space formed with the top face, the inner peripheral face and the inner boss 13 of the inner cap. The annular boss 12 is located so as to abut on the trunk of the pen under pressure when the pen is fitted into the cap and block the ventilation in the longitudinal direction.

The miniature cap 20 is a cylindrical body having a shoulder 24 on its outer periphery and bosses 26 symmetrical in the axial direction on the inner peripheral face and openings 27 on the upper side close to the shoulder, the inner lid 28 is a resilient, annular member fitted into the opening of the miniature cap 20 cylindrical body and, when the pen body is fitted into the cap, having a brim 29 which aids as a resilient seal for blocking the ventilation between the air vent 11 and the inside of the cap. The construction of the miniature cap is the same as that shown in FIGS. 8, 9.

The spring 22 acting as a rebounder downwardly pressing the miniature cap is installed in between the inner top face of the inner cap and the shoulder 24 of the miniature cap 20.

The inner cap 10 thus constructed is fitted into the outer tube 15 formed of a metal tube through a coupling member 50 and part of the opening of the metal tube is supplied with a cut 16 for engaging the piece 31 of the clip 30.

The coupling member 50 comprises a clip engaging portion 51 at the head, an intermediate small diameter cylinder 52 and a lower cylinder 54, the small diameter cylinder 52 internally communicating with the cylinder 54, and the side of the small diameter cylinder 52 being provided with a small vent 53. The coupling member 50 is pressed into the metal outer tube 15 with part of its head protruded therefrom and the head of the inner cap 10 is fitted into the cylinder 54 so that the inner cap may be fitted into the metal cylinder or outer tube 15. In that case, there is provided a gap between the inner face of the metal cylinder 15 and the side of the small diameter cylinder 52.

Figure 11:
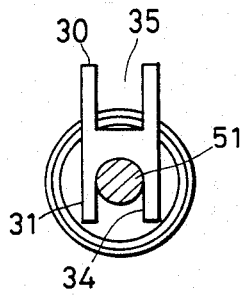
FIG. 11 is a sectional view taken on line A—A of FIG. 10.

The clip 30 is attached by fixing the piece 31 to the clip fixing portion 51 of the coupling member 50 and the cut 16 of the metal tube. The portion where the cut 16 engages with the clip piece is provided with a through hole 35 for allowing the gap 55 between the metal tube and the small diameter cylinder of the coupling member to communicate with the atmosphere (see FIGS. 10, 11).

During the course where the pen body is fitted into the cap, the front shoulder 62 of the pen body abuts on the lower face of the bosses 26 of the miniature cap and presses the miniature cap against the top face of the cap 10. However, the gap between the top face of the cap and the brim 29 of the inner lid on the top of the miniature cap is maintained until the pen body is completely fitted into the cap because of the repulsion of the spring 22. The air compressed within the inner cap is caused to pass through the miniature cap and discharged from the through hole 35 of the clip piece through the opening 27, the air vent 11, the interior of the small diameter cylinder 52 of the coupling member, ventilating opening 53 and the gap 55 between the side of the small diameter cylinder 52 and the inner face of the metal tube 15.

When the pen body is completely fitted into the cap, the miniature cap 20 is pressed against the pen body and the brim 29 of the inner lid is made to abut under pressure on the inner top face of the cap 10 and block the ventilation between the air vent 11 and the inside of the cap. Simultaneously, the annular boss 12 of the inner cap is allowed to abut on the trunk of the pen body 6 and block the ventilation in the longitudinal direction. Accordingly, the cap containing the tip 61 of the pen is kept airtight. In that case, the top face of the lid 28 plays a role as a seal for the tip of the pen.

Figure 12:
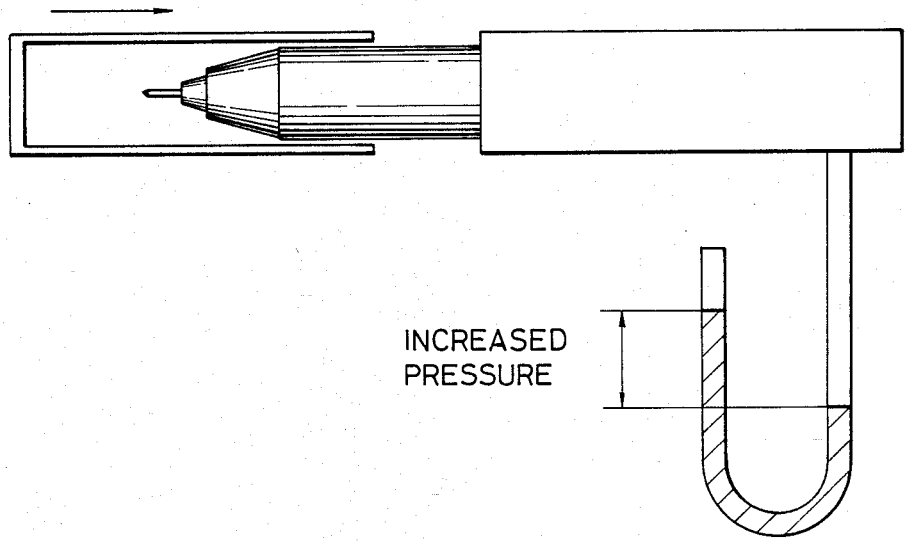
FIG. 12 PRIOR ART
FIG. 12 is a prior art diagram illustrating the method of measuring pressure changes in the pen drum when a pen body is fitted into a cap.

As shown in FIG. 12, the cap according to the present invention can maintain airtight condition when the pen body completely fitted into the cap. Any conventional cap without being equipped with a mechanism for releasing the internal compressed air produced during the process of fitting the pen body into the cap was examined to measure pressure changes in the pen body when the cap is mounted on the pen having no ink. The measurements resulted therefrom show an increase of 20~30 mm in water column compared with only 2~3 mm according to the present invention.

A pen body having a trunk of a capacity of about 2 ml and actually stored with a 1 ml of water and the pen core having a number of grooves, through which an ink is supplied to the tip of the pen, was repeatedly detached from a fitted connection with the cap of the present invention 400 times. However, no ink spout from the tip of the pen or the air vent in the tip portion occurred. On the other hand, according to a conventional cap, ink spout occurred at an average of every 7th repetition.

What is claimed is:

1. A cup shaped cylindrical pen body cap for closing off a pen body trunk of a writing instrument, said pen body cap being open at one end and being closed at the other end by a top, said pen body cap further comprising:

an air vent defined in the pen body cap top for communicating with the atmosphere;

means for providing airtightness disposed on the inner peripheral surface of said cylindrical pen body cap;

a miniature cap for covering a tip of said writing instrument, and for defining a first enclosed space between said writing instrument and an inner peripheral face of said miniature cap in which space said tip is disposed, said miniature cap having a top and being concentrically positioned in said cup shaped cylindrical pen body cap, said miniature cap being movable in the axial direction in a second enclosed space, said second enclosed space being formed between the inner face of said pen body cap top, the inner peripheral surface of said cylindrical pen body cap, and said means for providing airtightness;

an annular resilient seal positioned on the outer face of the top of the miniature cap, said annular resilient seal being sized and positioned for surrounding said air vent and blocking ventilation between said air vent and the inside of the cup shaped cylindrical pen body cap when a pen body trunk is fitted into said cap; and at least one opening defined in said miniature cap proximate to said miniature cap top and radially outside of said annular resilient seal for communicating said first enclosed space with a portion of said second enclosed space outside of said miniature cap, and wherein said means for providing airtightness is installed in a position for pressing against said trunk of said pen body to stop ventilation in the longitudinal direction.

2. A cap for a writing instrument as claimed in claim 1, wherein said pen body cap comprises an inner boss for preventing axial movement relative to said pen body trunk in the direction of said pen body trunk, said inner boss being provided on the inner peripheral surface of said cylindrical pen body cap to the side of said means for providing airtightness proximate to said pen body cap top, said air vent being provided in the center of the pen body cap, said miniature cap being equipped with an axially projecting boss at the center of the miniature cap top on the outer surface thereof, and forming a shoulder at the outer peripheral portion of the miniature cap top, a plurality of circumferentially spaced bosses on the inner peripheral face of said miniature cap and extending in the axial direction, said miniature cap being made of synthetic resin, means for communicating gaps between said circumferentially spaced bosses with an opening between said boss on the top center portion of the miniature cap top and the miniature cap outer face, wherein said annular resilient seal is a ring member fitted about said boss and wherein said at least one rebounder is a spring and accommodated between said shoulder and the inner face of said pen body cap top, and wherein said cap further comprises at least one rebounder within said pen body cap for pressing the miniature cap toward said pen body cap.

3. A pen body cap for writing instrument as claimed in claim 1, wherein said pen body cap has an inner top face and said inner top face and the inner peripheral surface of said pen body cap are formed by an inner tube integrated with an outer tube, said inner tube forming an inner boss at a lower end thereof, expanding to join said outer tube, and said air vent is formed at the center of said inner top face; said miniature cap being enclosed in the second enclosed space formed by said inner top face, said inner peripheral face and said inner boss; and said means for providing airtightness being provided on said inner periphery of said outer tube at a position lower than the portion where said inner tube abuts thereon.

4. A cap for writing equipment as claimed in claim 3, further comprising:

a cut end small gap communicating with a cut in the axial direction provided in a part of an opening of said outer tube, said outer tube opening being at a point axially higher than the inner tube;

a clip having a connecting portion fixed to said cut and having a piece inserted into a space between said inner and outer tubes, said piece being provided with a slit corresponding to said small gap and being aligned therewith; and a crown having a leg portion formed correspondingly to an annular gap between said inner and outer tubes and said leg portion being pressure inserted into said gap.

5. A cap for writing equipment as claimed in claim 4, wherein said miniature cap is a cylindrical body equipped with a shoulder, a plurality of circumferentially spaced bosses symmetrical about the inner periphery of said miniature cap, said at least one opening is positioned above said shoulder, said at least one spring is located between said shoulder and the inner face of said inner tube to define said at least one rebounder, said miniature cap is equipped with an inner lid of resilient material, and wherein said inner lid includes a brim constituting said annular resilient seal.

6. A cap for writing equipment as claimed in claim 4, wherein said means for providing airtightness comprises a continuous series of bosses.

7. A cap of writing instrument as claimed in claim 1, wherein said top face and an inner peripheral surface of said pen body cap are formed with an inner cap having an inner boss on said inner peripheral surface, and said air vent being provided in said top face of said inner cap; said means for providing airtightness being provided on said inner peripheral surface at a point axially lower than said inner boss; and said miniature cap being enclosed in the space formed by said inner top face; said inner peripheral surface and said inner boss.

8. A cap for writing equipment as claimed in claim 7, further comprising an outer tube provided with a gap formed in a head portion for communicating with the atmosphere and said inner cap being fitted in said outer tube.

9. A cap for writing equipment as claimed in claim 8, wherein said means for providing airtightness a continuous annular boss.

10. A cap for writing equipment as claimed in claim 8, further comprising a connecting member being formed from a clip fixing portion at a head portion, a lower tube and an intermediate small diameter tube connecting said fixing portion and said lower tube, said small diameter tube being provided with a side opening, wherein said outer tube is a metal tube having a cut provided in a part of an opening, said connecting member being pressed into said metal tube through said opening with a part of its head extending from said opening, the head of said inner cap engages with said lower tube of said coupling member and is fitted into said metal tube, said clip is attached to said metal tube by engaging a piece of said clip with said cut of said opening of said metal tube and engaging a cut provided at the end of said piece with said clip fixing portion of said coupling member, and a through hole is provided in said piece of said clip for communicating a gap between said metal tube and said small diameter tube of said coupling member with the atmosphere.

11. A cap for writing equipment as claimed in claim 10, wherein said miniature cap is a cylindrical body having a shoulder on the outer periphery, a plurality of bosses symmetrical about the inner peripheral face in the axial direction, and openings in the side wall between said bosses located higher than said shoulder, springs as said rebounders are set between said shoulder and the inner top face of said inner cap, an opening of said miniature cap is provided with an inner lid of resilient material, and a brim of said inner lid forms said resilient seal.

* * * * *